United States Patent [19]

Reider et al.

[11] Patent Number: 4,458,479

[45] Date of Patent: Jul. 10, 1984

[54] DIFFUSER FOR GAS TURBINE ENGINE

[75] Inventors: Samuel B. Reider; Thomas E. Scott, both of Indianapolis, Ind.

[73] Assignee: General Motors Corporation, Detroit, Mich.

[21] Appl. No.: 310,468

[22] Filed: Oct. 13, 1981

[51] Int. Cl.[3] ..... F02C 7/20

[52] U.S. Cl. ..... 60/39.32; 60/751

[58] Field of Search ..... 60/751, 39.31, 39.32

[56] References Cited

U.S. PATENT DOCUMENTS

| | | | |
|---|---|---|---|
| 3,372,542 | 3/1968 | Sevetz | 60/39.31 |
| 3,631,675 | 1/1972 | Keiter et al. | 60/751 X |
| 3,826,084 | 7/1974 | Branstrom et al. | 60/39.31 X |
| 3,877,221 | 4/1975 | Lefebvre et al. | 60/751 |
| 3,899,884 | 8/1975 | Ekstedt | 60/751 X |
| 4,180,972 | 1/1980 | Herman et al. | 60/751 X |

*Primary Examiner*—Carlton R. Croyle
*Assistant Examiner*—Jeffrey A. Simenauer
*Attorney, Agent, or Firm*—Saul Schwartz

[57] ABSTRACT

In a gas turbine engine having an annular combustor and an axial flow compressor discharging compressed air through a discharge annulus upstream of said combustor, the diffuser being supported on the engine independently of the combustor between the discharge annulus and a dome on the combustor and including inner and outer walls operative to direct first and second portions of compressor discharge to radially inner and outer air plenums at the combustor and a remaining third portion of compressor discharge flow to a combustor dome feed chamber ahead of the dome, an improvement in the form of radially oriented pins on the diffuser and guides on the combustor dome slidably received on the pins, the pins and guides cooperating in maintaining a predetermined positional relationship between the diffuser and the combustor during relative thermal growth of the latter whereby at normal operating temperature the diffuser outer wall seals against the combustor while a flow balancing slot is developed between the diffuser inner wall and the combustor.

3 Claims, 2 Drawing Figures

DIFFUSER FOR GAS TURBINE ENGINE

BACKGROUND OF THE INVENTION

Figure 1:
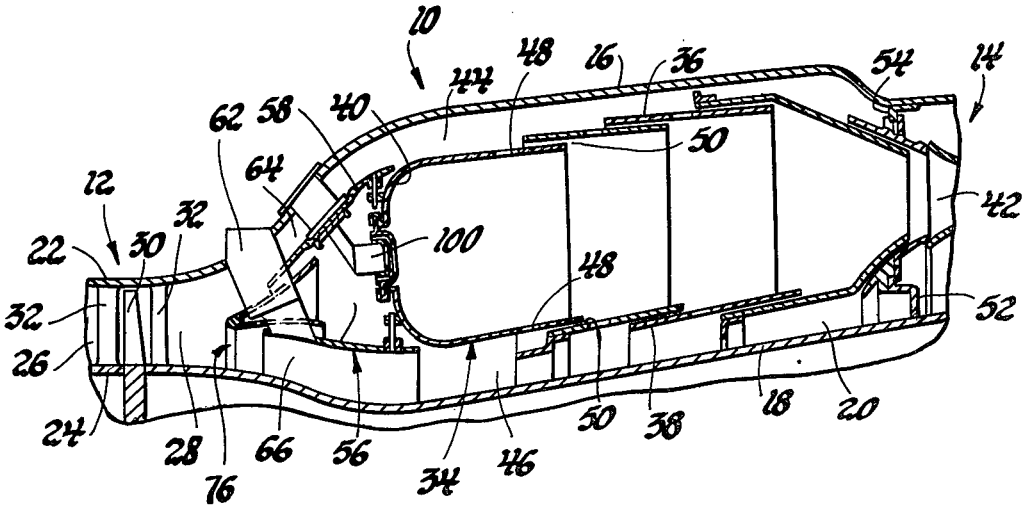

This invention relates generally to gas turbine engines and, more particularly, to an improvement in diffusers for gas turbine engines having axial flow compressors and annular combustors.

In gas turbine engines of the type having axial flow compressors and annular combustors, it is desirable that compressor discharge flow be divided between a radially inner plenum, a radially outer plenum, and a combustor dome feed chamber at the combustor dome generally in the proportions assumed during engine design. Achievement of such distribution is complicated, however, by the radially variable nature of the compressor discharge flow field during engine operation, this variability manifesting itself as a variation in compressor discharge pressure and/or compressor discharge flow radially across the compressor discharge opening. In one proposal for achieving proportional compressor discharge distribution, a diffuser between the compressor discharge opening and the combustor divides the discharge flow between inner and outer plenums and a combustor dome feed chamber ahead of the combustor dome, the diffuser cooperating with the combustor in defining a fixed slot for bleeding air from the combustor dome feed chamber to the inner plenum to automatically compensate for discharge profile irregularities. For a detailed description of this proposal reference may be made to U.S. Pat. No. 3,877,221, issued Apr. 15, 1975 to Arthur H. Lefebvre et al and assigned to the assignee of this invention. A gas turbine engine having a diffuser according to this invention incorporates novel improvements over the Lefebvre et al proposal and other heretofore known structures.

SUMMARY OF THE INVENTION

Accordingly, the primary feature of this invention is that it provides a new and improved diffuser structure for gas turbine engines of the type having axial flow compressors and annular combustors. Another feature of this invention is that it provides a new and improved diffuser structure wherein compressor discharge flow distribution between inner and outer plenums and a combustor dome feed chamber self-adjusts to maintain preselected flows to the inner and outer plenums and through a dome of the combustor. Still another feature of this invention resides in the provision in the new and improved diffuser structure of a diffuser supported on the engine independently of the combustor and with downstream extremities located such that radial thermal expansion of the combustor incident to normal engine operation effects substantially sealing engagement between a radially outer trailing edge of the diffuser and the combustor to curtail airflow from the combustor dome feed chamber to the outer plenum and simultaneous creation of a slot between a radially inner trailing edge of the diffuser and the combustor for automatically adjusting airflow to the inner plenum in response to compressor discharge profile variation. A still further feature of this invention resides in the provision in the new and improved diffuser structure of pin and guide means on the diffuser and on the combustor operative to maintain a positional relationship between the diffuser and the combustor during relative thermal growth whereby sealing at the radially outer diffuser trailing edge and slot formation at the radially inner trailing edge is effected.

Figure 2:
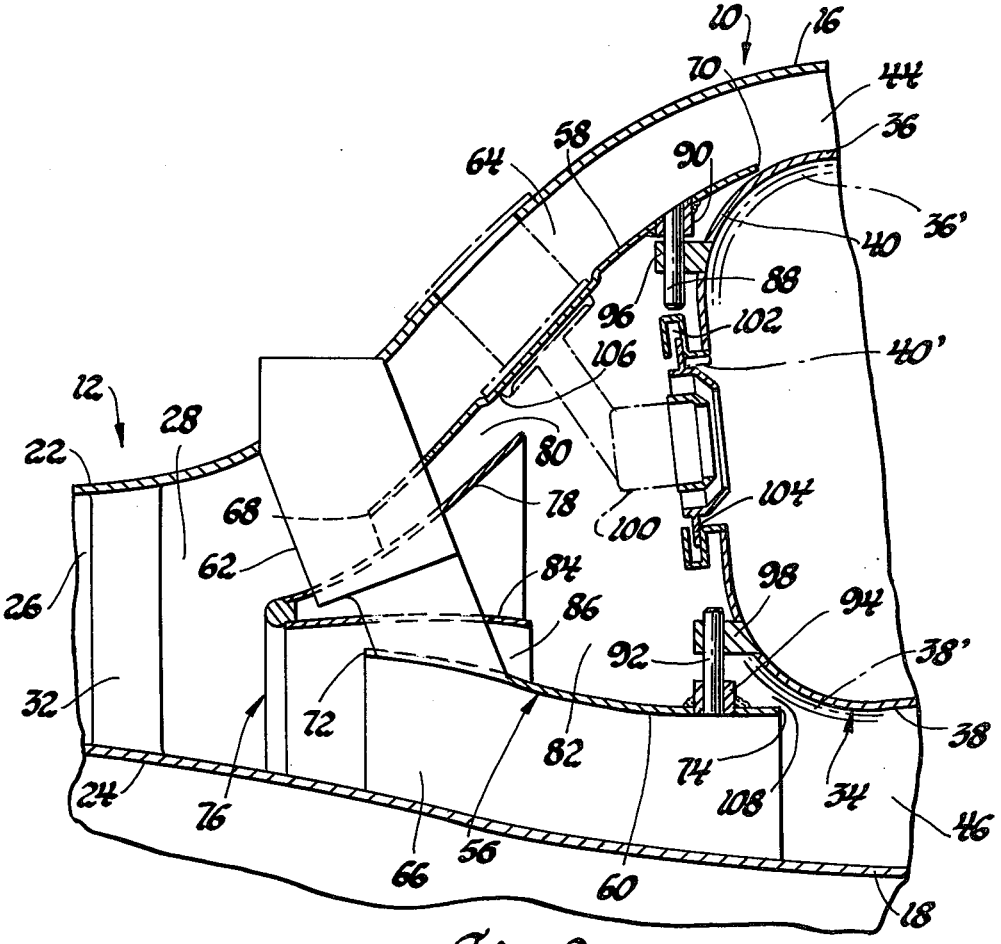

These and other features of this invention will be readily apparent from the following specification and from the drawings wherein:

FIG. 1 is a sectional view of a portion of a gas turbine engine having a diffuser structure according to this invention; and FIG. 2 is an enlarged view of a portion of FIG. 1 showing particularly the diffuser structure according to this invention.

Referring first to FIG. 1 of the drawings, a gas turbine engine has a combustor section designated generally 10 located longitudinally between a compressor section 12 and a turbine section 14. The combustor section 10 includes a generally cylindrical outer casing 16 and a generally cylindrical inner casing 18 located within the outer casing and cooperating with the latter in defining an annular volume 20. The compressor section 12, generally schematically illustrated in FIG. 1, has a cylindrical outer wall 22 and a cylindrical inner wall 24 which walls define between them an airflow annulus 26 and which walls merge smoothly with outer and inner casings 16 and 18 of the combustor section at a compressor discharge annulus 28. A rotor blade stage 30, representative of a plurality of such stages, rotates in the annulus 26 and cooperates with a plurality of stator vane stages 32 disposed in the annulus in compressing air from ambient pressure to some predetermined higher pressure level and discharging the compressed air through discharge annulus 28 into the volume 20 between the inner and outer casings. In an ideal compressor, the profile of the compressor discharge flow at the discharge, annulus 28, in terms of discharge pressure, discharge flow rate, or the like, is constant across the annulus 28 in the radial direction. Real considerations, however, such as boundary layer effects and transient irregularities combine to alter the compressor discharge flow profile at the discharge annulus such that the discharge flow profile tends to be maximum at the center of the annulus and decreasing toward each of the walls 22 and 24 with the instantaneous magnitudes of the discharge flow profile varying virtually continuously during compressor operation due to the transient irregularities.

Referring again to FIG. 1 of the drawings, a combustor 34 is disposed in the annular volume 20 and includes a generally cylindrical outer liner 36 and a generally cylindrical inner liner 38 disposed radially inward relative to the outer liner. At the upstream end of the combustor 34 closest to compressor discharge annulus 28 the inner and outer liners converge and join together at a dome 40 which closes the upstream end of the combustor. At their downstream ends, the inner and outer liners converge to direct products of combustion through a nozzle 42 which, in turn, directs the products of combustion against blades on a turbine rotor, not shown, in turbine section 14. The outer liner 36 cooperates with the outer casing 16 in defining an annular outer plenum 44 and the inner liner 38 similarly cooperates with the inner casing 18 in defining an annular inner plenum 46, both the inner and outer plenums being in communication with the interior of the combustor through a plurality of primary and cooling air ports 48 and 50 in the inner and outer liner. At their downstream ends, the inner and outer plenums 46 and 44 are closed by a pair of radial flanges 52 and 54, respectively, which are attached to the inner and outer casings and to the inner and outer combustor liners 38 and 36, respectively. The flanges 52 and 54, in addition to closing the plenums, also allow for radial and axial growth of the combustor with respect to the casings 18 and 16.

Referring now to both FIGS. 1 and 2, an annular diffuser 56 is disposed in the annular volume 20 between the discharge annulus 28 and the combustor dome 40 and includes an outer wall 58 generally parallel to and spaced from the outer casing 16 and an inner wall 60 generally parallel to and spaced from the inner casing 18. The inner and outer walls 60 and 58 are rigidly attached to outer casing 16 by means of a plurality of generally radially directed struts, only one such strut 62 being shown in FIGS. 1 and 2, and cooperate with inner and outer casings 18 and 16 in defining an outer duct 64 from compressor discharge annulus 28 to outer plenum 44 and an inner duct 66 from compressor discharge annulus 28 to inner plenum 46. The outer wall 58 has a leading edge 68 generally adjacent and downstream from discharge annulus 28 and a trailing edge 70 generally adjacent the combustor outer liner 36 at the transition of the latter to dome 40. Similarly, the inner wall 60 of the diffuser has a leading edge 72 radially inwardly spaced from the leading edge 68 and generally adjacent and downstream from discharge annulus 28 and a trailing edge 74 generally adjacent combustor inner liner 38 at the transition of the latter to dome 40. An annular air deflector 76 is rigidly attached to the radial struts supporting the walls 58 and 60 and disposed between the leading edges 68 and 72. The deflector 76 includes a first partition 78 which cooperates with the outer wall 58 in defining a first path 80 into a combustor dome feed chamber 82 defined between the dome 40 of the combustor and the walls 58 and 60 of the diffuser and a second partition 84 which cooperates with the inner wall 60 in defining a second path 86 into the chamber 82.

As seen best in FIG. 2, an outer array of radially inwardly directed pins rigidly attached to the outer wall 58 of the diffuser 56 generally adjacent the dome 40 of the combustor 34, is exemplified by a radially inwardly directed pin 88 rigidly attached to the outer wall 58 at a fitting 90 shown in FIG. 2. A similar inner array of radially outwardly directed pins attached to the inner wall 60 of the diffuser 56 generally adjacent the dome 40 of the combustor is exemplified by a radially outwardly directed pin 92 rigidly attached to inner wall 60 at a fitting 94 shown in FIG. 2. Cooperating with the outer pin array is a corresponding array of guides slidably received on respective ones of the radially inwardly directed pins and rigidly attached to the dome 40 generally adjacent the outer liner 36, only one guide 96 attached to dome 40 and slidably received on pin 88 being shown in FIG. 2. Similarly cooperating with the inner pin array is a corresponding array of guided slidably received on respective ones of the radially outwardly directed pins and rigidly attached to the dome 40 generally adjacent the inner liner 38, only one guide 98 attached to the dome 40 and slidably received on pin 92 being shown in FIG. 2.

A fuel nozzle 100, representative of a plurality of fuel nozzles disposed around the annular combustor 34, is supported on the outer casing 16 and projects through the outer duct 64 and the outer wall 58 of the diffuser for connection to the combustor dome 40 at a circular slot 102 on the dome which receives a flange 104 on the nozzle, the slot and flange connection permitting radial displacement of the dome relative to the nozzle. A similar flange and slot arrangement 106 between the nozzle 100 and the outer wall 58 of the diffuser accommodates limited relative movement between the nozzle and the diffuser.

Describing now the operation of the diffuser 56, when the engine is inoperative and all components are generally at ambient temperature, the outer liner 36, the inner liner 38, and the dome 40 assume radially inboard positions shown in broken lines in FIG. 2 and designated 36', 38', and 40' respectively. In this situation a narrow slot 108 between trailing edge 74 of inner wall 60 and the inner liner 38 exists and another slot, not shown, exists between the trailing edge 70 and the outer line 36 at the transition of the latter to dome 40. At ignition, air is compressed in the compressor and discharged through annulus 28 where the diffuser 56 divides the discharge into three portions. More particularly, a first portion of compressor discharge flow through discharge annulus 28 is directed by outer wall 58 into outer duct 64 and into outer plenum 44 for subsequent flow into the combustor. Similarly, inner wall 60 directs a second portion of the compressor discharge flow through discharge annulus 28 into inner duct 66 and into inner plenum 46 for subsequent flow into the combustor. A third portion, the remainder of compressor discharge flow through annulus 28, is directed through the first path 80 and the second path 86 into the chamber 82 within the diffuser ahead of the dome 40.

As soon as combustion is initiated in combustor 34 the temperature of the combustor rises rapidly relative to the diffuser 56 which is located in a relatively low temperature stream of compressed air. As the temperature of the combustor increases, relative thermal growth occurs between the diffuser and the outer and inner liners 36 and 38 and the dome 40, all three components expanding radially from the broken line positions 36', 38' and 40' to the solid line positions shown in FIG. 2. As relative thermal growth progresses, the arrays of radially inwardly directed pins and radially outwardly directed pins, exemplified by pins 88 and 92 respectively, cooperate with the corresponding arrays of guides, exemplified by guides 96 and 98 respectively, in maintaining a predetermined positional relationship between the diffuser 56 and the combustor. When normal combustor operating temperature is achieved and thermal growth has essentially ceased, the positional relationship maintained by the arrays of pins and cooperating guides establishes essentially sealing engagement between the trailing edge 70 and the outer liner 36 at its transition to dome 40 so that the previously existing slot between outer duct 64 and combustor dome feed chamber 82 is closed. Conversely, at normal operating temperature the positional relationship maintained by the arrays of pins and cooperating guides develops a slot 108 of preselected depth between trailing edge 74 of inner wall 60 and the inner liner 38 at the latter's transition to dome 40. The slot 108 provides direct communication between combustor dome feed chamber 82 and inner duct 66 leading to inner plenum 46.

During engine operation, pressurized air is continuously discharged through discharge annulus 28 in accordance with the instantaneous operating parameters of the engine and with a discharge flow profile as described hereinbefore generally maximum at the center of the annulus and tapering off toward the inner and outer walls 22 and 24. The leading edges 68 and 72 are located radially with respect to the boundaries of the discharge annulus 28 to divide the compressor discharge flow into the three previously described predetermined portions based on an assumed discharge flow profile which takes into account the steady state irregularities of the profile and provides for a predetermined bleedoff of air from the collection chamber 82 through slot 108 into inner duct 66. When transient irregularities in the discharge flow profile result in more or less compressor discharge flow being channeled into the combustor dome feed chamber 82, the slot 108 automatically adjusts the air bleed to compensate for the change as described in the aforementioned Lefebvre et al patent.

When engine operation ceases, cooling of the engine components occurs and the inner and outer liners 38 and 36 and the dome 40 thermally contract relative to the diffuser 56. During this relative movement the arrays of pins and cooperating guides maintain a positional relationship between the diffuser 56 and the combustor 34 which causes the inner and outer liners and the dome to assume the broken line positions 38', 36' and 40' in preparation for the next succeeding thermal expansion cycle. Accordingly, it will be apparent that the relative thermal growth permitted by the pins and guides forecloses the development of thermal stresses created by uneven relative thermal growth between rigidly connected components.

The embodiments of the invention in which an exclusive property or privilege is claimed are defined as follows:

1. In a gas turbine engine having an axial flow compressor, an annular combustor downstream of a discharge annulus of said compressor having a radially inner liner and a radially outer liner and an interconnecting dome each exhibiting radially outward thermal growth with increasing combustor temperature up to a normal combustor operating temperature, means defining radially inner air duct means for directing air from said discharge annulus to said combustor, means defining radially outer air duct means for directing air from said discharge annulus to said combustor, a diffuser including an outer wall for directing a first portion of compressor discharge flow to said radially outer air duct means and an inner wall for directing a second portion of compressor discharge flow to said radially inner air duct means, and means rigidly supporting said diffuser on said gas turbine engine independently of said combustor with said inner and said outer walls spaced radially apart adjacent said discharge annulus therby to direct a third portion of compressor discharge flow to a combustor dome feed chamber of said diffuser ahead of said dome, the improvement comprising, a first guide means between said outer wall and said outer liner operative to maintain a predetermined positional relationship between said outer wall and said outer liner during radial thermal growth of said outer liner whereby at substantially said normal combustor operating temperature said outer wall sealingly engages said outer liner to prevent communication between said combustor dome feed chamber and said radially outer air duct means, and second guide means between said inner wall and said inner liner operative to maintain a predetermined positional relationship between said inner wall and said inner liner whereby at substantially said normal combustor operating temperature a slot of preselected depth is developed between said inner wall and said inner liner permitting communication between said combustor dome feed chamber and said radially inner air duct means to maintain satisfactory compressor discharge flow distribution regardless of radial variation in compressor discharge flow profile at said-discharge annulus.

2. In a gas turbine engine having an axial flow compressor, an annular combustor downstream of a discharge annulus of said compressor having a radially inner liner and a radially outer liner and a dome each exhibiting radially outward thermal growth with increasing combustor temperature up to a normal combustor operating temperature, means defining radially inner air duct means for directing air from said discharge annulus to said combustor, means defining radially outer air duct means for directing air from said discharge annulus to said combustor, a diffuser including an outer wall for directing a first portion of compressor discharge flow to said radially outer air duct means and an inner wall for directing a second portion of compressor discharge flow to said radially inner air duct means, and means rigidly supporting said diffuser on said gas turbine engine independently of said combustor with said inner and said outer walls spaced radially apart adjacent said discharge annulus thereby to direct a third portion of compressor discharge flow to a combustor dome feed chamber of said diffuser ahead of said dome, the improvement comprising, a first pin disposed on one of said outer liner and said outer wall, first guide means on the other of said outer liner and said outer wall defining a guide slidably receiving said first pin so that said first pin and said first guide means cooperate in maintaining a predetermined positional relationship between said outer liner and said outer wall during radial thermal growth of said outer liner whereby at substantially said normal combustor operating temperature said outer wall sealingly engages said outer liner to prevent communication between said combustor dome feed chamber and said radially outer air duct means, a second pin on one of said inner liner and said inner wall, and second guide means on the other of said inner liner and said inner wall defining a guide slidably receiving said second pin so that said second pin and said second guide means cooperate in maintaining a predetermined positional relationship between said inner liner and said inner wall whereby at substantially said normal combustor operating temperature a slot of preselected depth is developed between said inner liner and said inner wall permitting communication between said combustor dome feed chamber and said radially inner air duct means to maintain satisfactory compressor discharge flow distribution regardless of radial variation in compressor discharge flow profile at said discharge annulus.

3. In a gas turbine engine having an axial flow compressor, an annular casing downstream of a discharge annulus of said compressor, an annular combustor within said annular casing having a radially outer liner spaced from said casing to define therewith an outer air plenum and a radially inner liner spaced from said casing to define therewith a radially inner air plenum and a dome interconnecting said inner and said outer liners, each of said inner and said outer liners and said dome exhibiting radially outward thermal growth corresponding to increasing combustor temperature up to a normal combustor operating temperature, a diffuser including an outer wall cooperating with said casing in defining a radially outer air duct for directing a first portion of compressor discharge flow to said outer air plenum and a diffuser inner wall cooperating with said casing in defining a radially inner air duct for directing a second portion of compressor discharge flow to said inner air plenum, and means rigidly supporting said diffuser on said gas turbine engine independently of said combustor with said inner and said outer walls spaced radially apart adjacent said discharge annulus thereby to direct a third portion of compressor discharge flow to a combustor dome feed chamber of said diffuser ahead of said dome, the improvement comprising, a plurality of radially inwardly directed first pins each rigidly attached to said outer wall generally adjacent said outer liner, a correponding plurality of first guides rigidly attached to said dome and slidably receiving corresponding ones of said first pins so that said first pins and said first guides cooperate in maintaining a predetermined positional relationship between said outer liner and a trailing edge of said outer wall during radial thermal growth of said outer liner whereby at substantially said normal combustor operating temperature said trailing edge sealingly engages said outer liner to prevent communication between said combustor dome feed chamber and said radially outer air duct, a plurality of radially outwardly directed second pins rigidly attached to said inner wall generally adjacent said inner liner, and a corresponding plurality of second guides rigidly attached to said dome and slideably receiving corresponding ones of said second pins so that said second pins and said second guides cooperate in maintaining a predetermined positional relationship between said inner wall and said inner liner whereby at substantially said normal combustor operating temperature a slot of preselected depth is developed between said inner wall and said inner liner permitting communication between said combustor dome feed chamber and said radially inner air duct to maintain satisfactory compressor discharge flow distribution regardless of radial variation in compressor discharge flow profile at said discharge annulus.

* * * * *